United States Patent [19]

Adler

[11] 4,135,608

[45] Jan. 23, 1979

[54] ADJUSTABLE SUPPORT FOR BOTTOM BRAKE CONNECTING RODS FOR RAILWAY CARS

[75] Inventor: Franklin P. Adler, Michigan City, Ind.

[73] Assignee: Illinois Railway Equipment Company, Chicago, Ill.

[21] Appl. No.: 832,287

[22] Filed: Sep. 12, 1977

[51] Int. Cl.[2] ..... B61H 16/38

[52] U.S. Cl. ..... 188/210

[58] Field of Search ..... 188/206 R, 207, 210, 188/213

[56] References Cited

U.S. PATENT DOCUMENTS

| | | | |
|---|---|---|---|
| 1,644,880 | 10/1927 | Hawkins | 188/210 |
| 1,841,600 | 1/1932 | Haskell | 188/210 |
| 2,077,547 | 4/1937 | Bosse | 188/210 |
| 3,703,225 | 11/1972 | Spaeth | 188/210 |

*Primary Examiner*—Duane A. Reger

*Attorney, Agent, or Firm*—Lockwood, Dewey, Alex & Cummings

[57] ABSTRACT

There is provided an improved safety support for adjustable mounting on brake beams of railway cars for supporting one end of a bottom connecting rod should it become detached from the brake rigging. In one modification attachment, pieces are arranged to be mounted at different elevations on a brake beam for supporting the upper ends of the safety support. In other modifications, attachment pieces are arranged for different angular mounting positions and/or different elevations in conjunction with separate positioning brackets. In still another modification right and left hand L-shaped attachment pieces have a plurality of holes in their vertical legs for mounting at different elevations and the distal ends of their horizontal legs overlap and are interconnected.

14 Claims, 33 Drawing Figures

FIG. 7
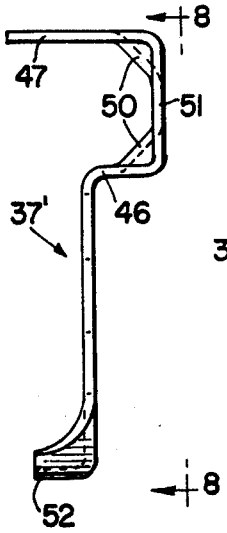
FIG. 8
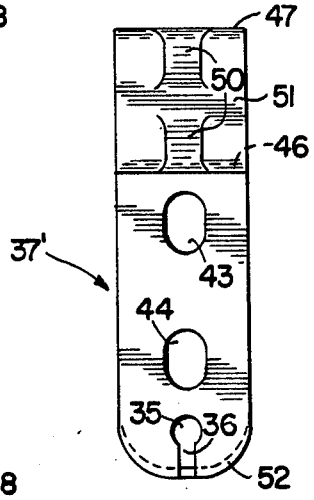
FIG. 9
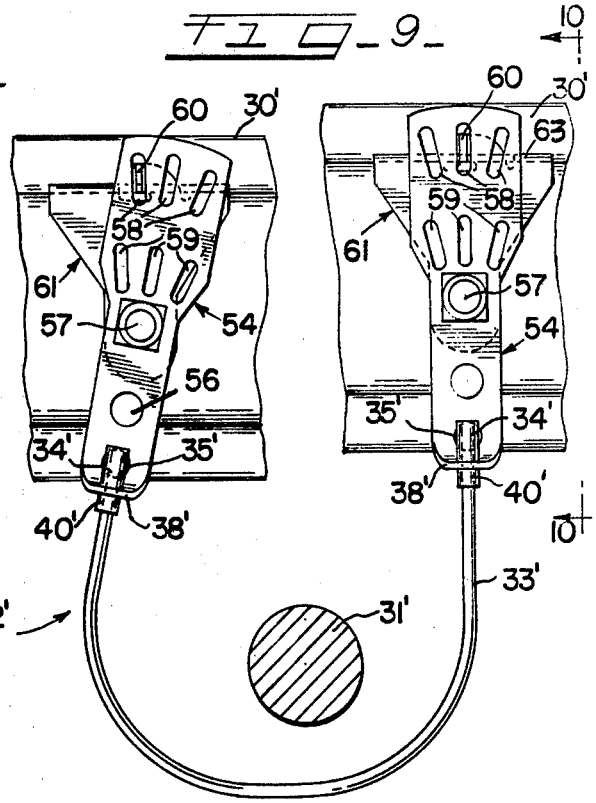
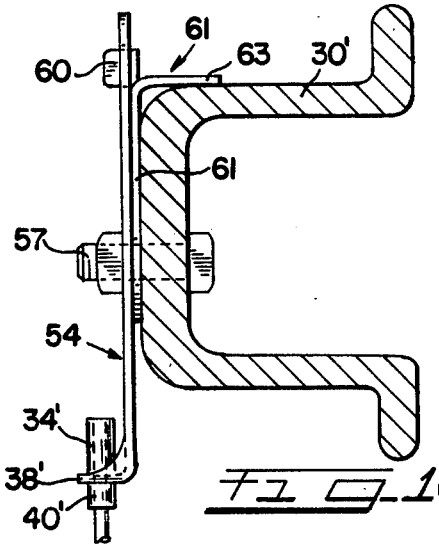
FIG. 10
FIG. 12
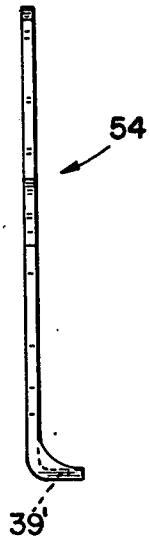
FIG. 11
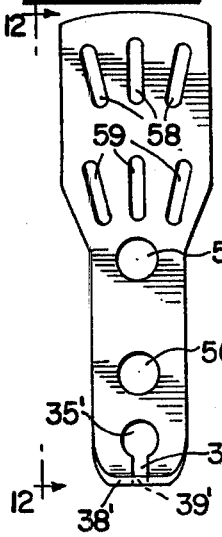
FIG. 13
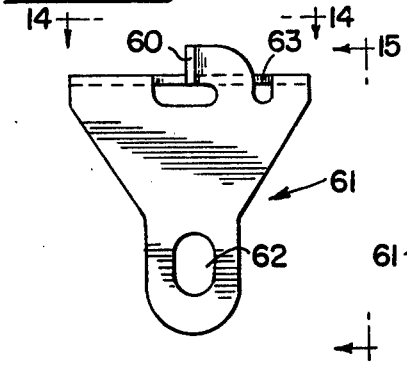
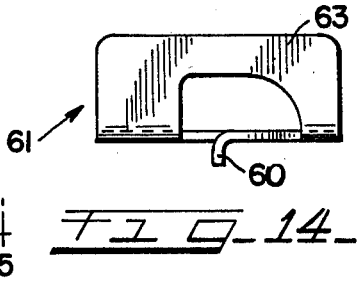
FIG. 14
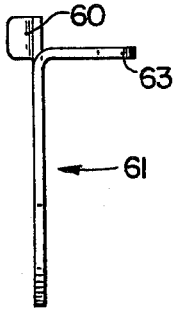
FIG. 15

FIG. 16
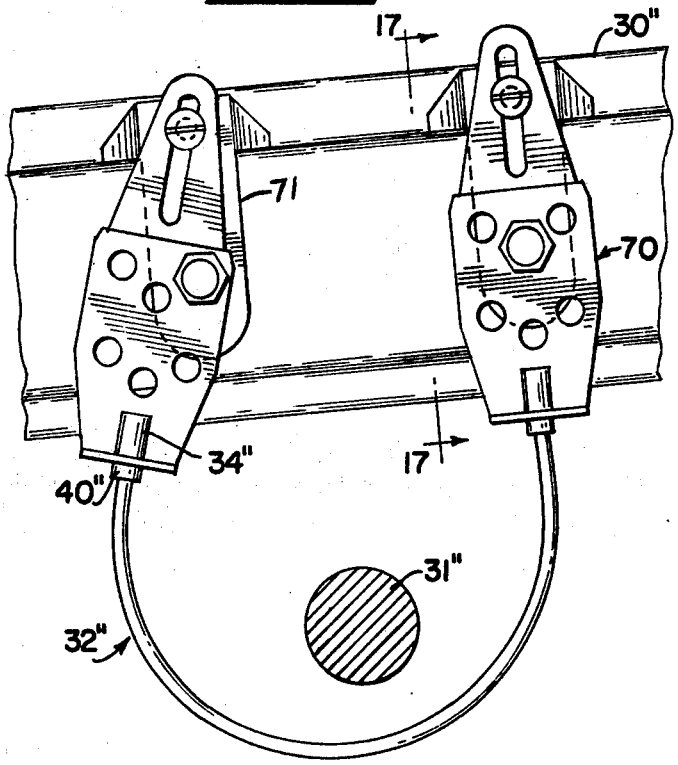
FIG. 17
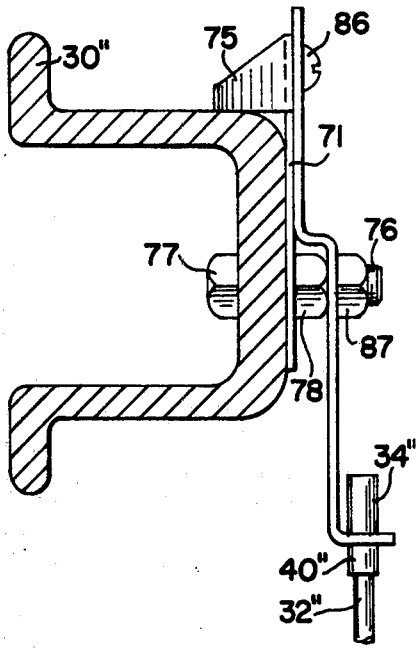
FIG. 19
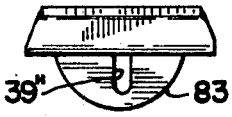
FIG. 22
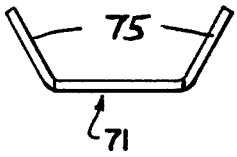
FIG. 23
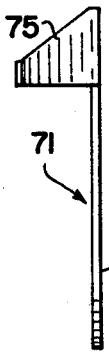
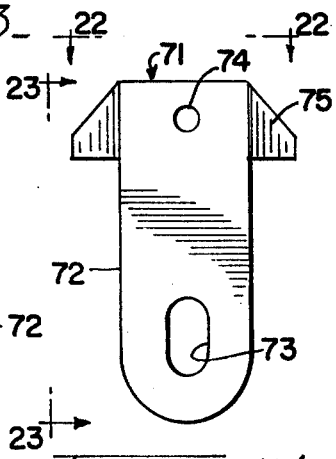
FIG. 21
FIG. 18
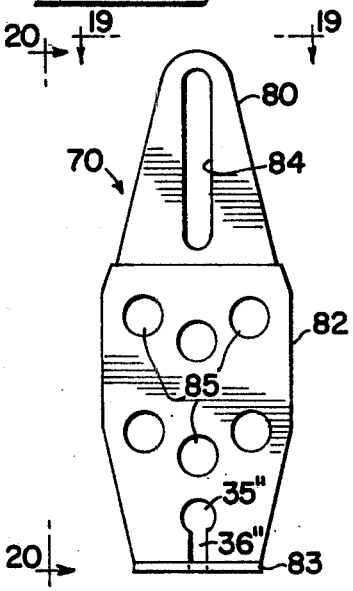
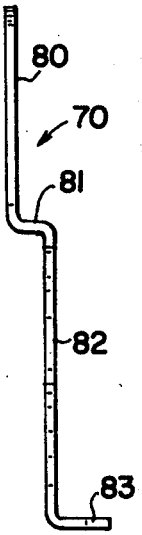
FIG. 20

ADJUSTABLE SUPPORT FOR BOTTOM BRAKE CONNECTING RODS FOR RAILWAY CARS

This invention relates, generally, to railway car construction and it has particular relation to supports for bottom connecting rods underlying the brake beams and forming a part of the brake rigging.

In the past it has been customary to employ rigid, generally "U"-shaped, safety straps for underlying bottom connecting rods forming a part of the brake rigging of railway cars. For example, 1¼" by ¼" steel bars have been used with the apertured upper ends secured by ½" diameter bolts to the inner sides of a pair of oppositely disposed brake beams. The bottom connecting rods are spaced only a slight distance above the track rails. The safety straps necessarily extend below the bottom connecting rods and close to the tops of the rails where they are susceptible to damage and likely to be bent or broken. Damaged safety straps and missing bolts are often found in cars that have been in service for some time. It has been noted that derailments have been caused by fallen bottom connecting rods which could have been prevented if the safety support had been operable.

The proposal has been made to employ 3/16" plastic coated cable for underlying the bottom connecting rods. Bolting clips are secured to the ends of the cable by swagging for receiving bolts for attachment to the brake beams. Examination of several cars in actual service using this type of support revealed some were missing, some were loose and some had the cable worn where it rubbed on the underside of the bottom connecting rod it was intended to prevent from dropping in case it should become disconnected from the brake rigging.

In view of the foregoing, among the objects of this invention are: to provide, in a new and improved manner, for supporting bottom connecting rods of railway car brake rigging should they become detached from the brake rigging; to provide adjustable mounting for the bottom rod supports; to emply offset portions on attachment pieces arranged to carry a flexible cable underlying the bottom connecting rods to locate the attachment pieces at different elevations on the brake beams; to rigidify the offset portions; to provide slotted foot portions on the attachment pieces to receive the respective ends of the flexible cable; to secure stop means to the cable ends to prevent downward withdrawal of the cable ends through the foot portions; to secure additional stop means to the cable ends underneath the foot portions to prevent upward withdrawal of the cable ends; to provide the foot portions with key-shaped slots for receiving the cable ends with the upper stop means attached; to provide the attachment pieces with radially extending slots for receiving a stationary positioning flange to locate the attachment pieces in different angular positions on the brake beams and mount each attachment piece on a positioning bracket underlying each attachment piece and having a positioning flange; to provide attachment pieces each with a generally axially extending slot on its upper end and a plurality of spaced bolt holes in a lower portion, said slot receiving a bolt protruding from a support bracket mounted on a brake beam and said bolt holes receiving a bolt mounting the support bracket on the brake beam; and to provide attachment pieces in the form of right and left-hand L-shaped members with the vertical legs thereof having a plurality of mounting holes and the distal ends of the horizontal legs thereof overlapping and pivoltally connected.

IN THE DRAWINGS:

FIG. 7 is a view in side elevation of a modified form of the attachment piece.

FIG. 8 is a view in front elevation of the attachment piece shown in FIG. 7 taken on line 8—8.

FIG. 9 is a view, similar to FIG. 2, showing another embodiment of this invention.

FIG. 10 is a view taken on line 10—10 of the safety support shown in FIG. 9.

FIG. 11 is a view in front elevation of one of the attachment pieces shown in FIG. 9.

FIG. 12 is a view in side elevation of the attachment piece shown in FIG. 11 taken on line 12—12.

FIG. 13 is a view in front elevation of one of two positioning brackets employed, as shown in FIG. 9, for mounting the attachment pieces on the brake beam.

FIG. 14 is a top plan view of the positioning bracket shown in FIG. 13 taken on line 14—14.

FIG. 15 is a view of the positioning bracket shown in FIG. 13 taken on line 15—15.

FIG. 16 is a fragmentary, front elevational view similar to FIGS. 2 and 9, showing a further embodiment of the invention.

FIG. 17 is a detail sectional view taken on line 17—17 of FIG. 16.

FIG. 18 is a front elevational view of one of the two attachment pieces shown in FIG. 16.

FIG. 19 is a top plan view taken on line 19—19 of FIG. 18.

FIG. 20 is a side elevation taken on line 20—20 of FIG. 18.

FIG. 21 is a front elevation of one of the two positioning brackets shown in FIGS. 16 and 17 for mounting the attachment pieces on the brake beam.

FIG. 22 is a top plan view taken on line 22—22 of FIG. 21.

FIG. 23 is a side elevation taken on line 23—23 of FIG. 21.

Figure 1:
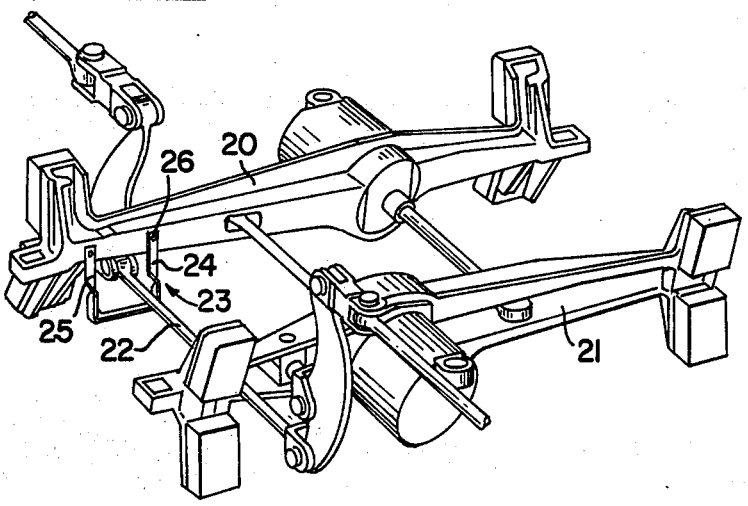
FIG. 1 PRIOR ART
FIG. 1 is a perspective view of a conventional railway car brake assembly showing a pair of spaced apart brake beams having mounted on one of them a safety support of the prior art construction underlying a bottom connecting rod, it being understood that a safety support is mounted on each brake beam near the ends of the bottom connecting rod.

Referring to FIG. 1, which shows a prior art construction, reference characters 20 and 21 designate brake beams at the "B" end of a railway car having a bottom connecting rod 22 underlying them. Each brake beam is provided with a safety support, one of which is shown, generally, at 23. It is formed of a steel bar, as described above, and is generally stirrup-shaped with apertured twisted upper ends 24 and 25 for receiving bolts 26 that extend through the respective brake beam 20.

One embodiment of this invention is illustrated in FIGS. 2–6. A portion of a brake beam is shown at 30 and the corresponding bottom connecting rod is shown at 31. At 32 there is shown, generally, a safety support for the bottom connecting rod 31 which comprises a flexible cable 33, preferably a 3/16" 7×7 galvanized aircraft cable, having upper sleeve stops 34 of galvanized steel swagged to its upper ends. It will be understood that the ends of the flexible cable 33, with the sleeve stops 34, are inserted through upper circular portions 35 of key-shaped openings 36 that are formed in the lower ends of attachment pieces 37, the details of construction of which are shown more clearly in FIGS. 5 and 6. Each attachment piece 37 has a laterally extending foot portion 38 having a slot 39 therein extending from the keyhole-shaped opening 36 to receive the portion of the flexible cable 33 immediately below an upper sleeve stop 34, the lower end of which bears against the upper side of the foot portion 38. The upper ends of the flexible cable 33 are secured to the respective foot portions by lower sleeve stops 40, preferably formed of aluminum, which are also swagged to the cable ends and bear tightly against the undersides of the foot portions 38.

Figure 3:
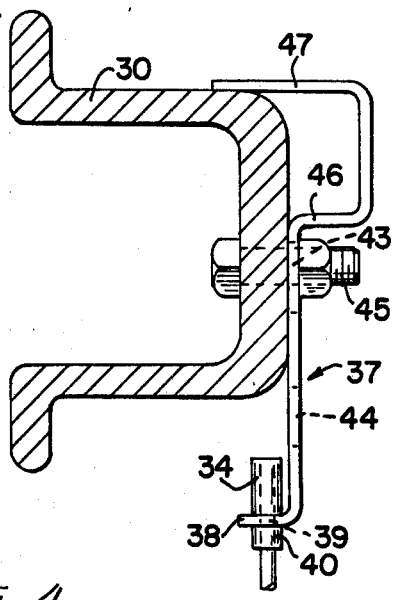
FIG. 3 is a view taken on line 3—3 of the safety support shown in FIG. 2, with the adjustable attachment piece located in its lowermost position on a brake beam.
Figure 2:
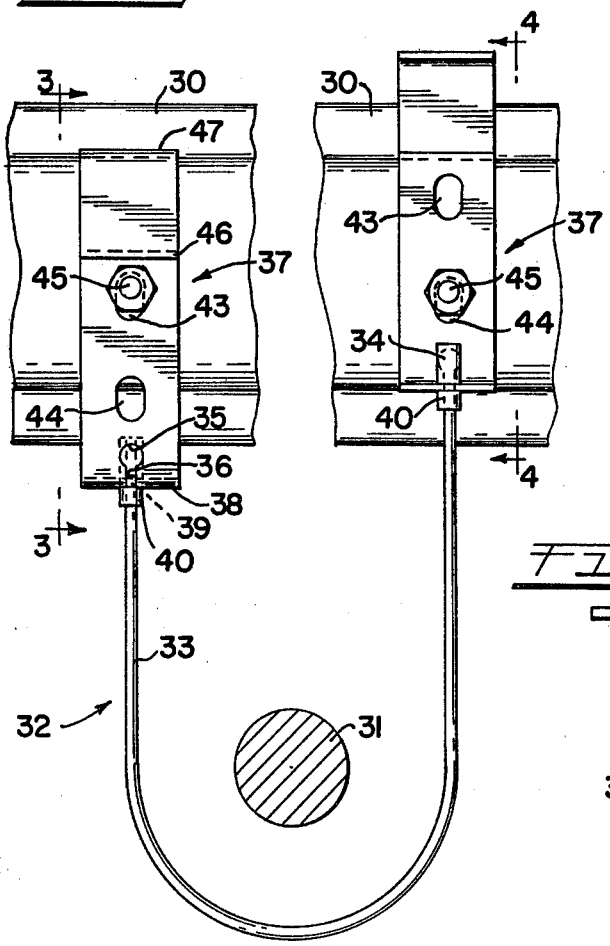
FIG. 2 is a fragmentary view, in front elevation, of a safety support for the bottom connecting rod in which this invention is embodied.
Figure 4:
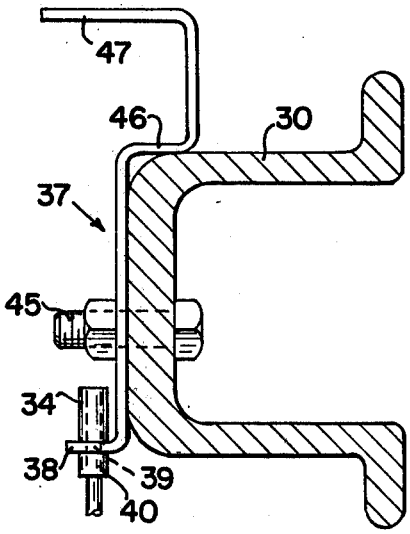
FIG. 4 is a view taken on line 4—4 of the safety support shown in FIG. 2 with the adjustable attachment piece located in its uppermost position on the brake beam.
Figure 5:
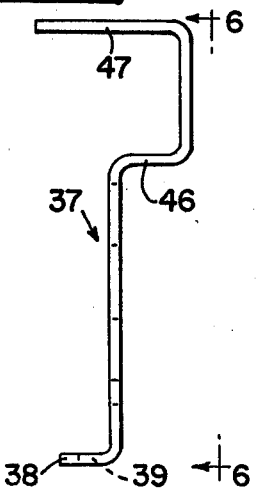
FIG. 5 is a view in side elevation of the attachment piece shown in FIGS. 2-4.
Figure 6:
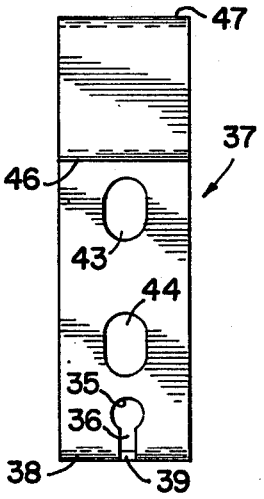
FIG. 6 is a view in front elevation of the attachment piece taken on line 6—6 of FIG. 5.

Preferably the attachment pieces 37 are formed of ⅛" galvanized steel plate. They are provided with upper and lower slotted holes 43 and 44 for receiving bolts 45 to mount and secure the attachment pieces at different elevations on the brake beam 30 as shown in FIGS. 2–4. In addition, each attachment piece 37 has an intermediate offset shoulder portion 46 which, in one position of piece 37, FIG. 4, overlies the upper surface of the brake beam 30 and a lateral flange 47 at the upper end which, in a reversed position of piece 37, FIG. 3, overlies the upper surface of the brake beam 30. The provision of the upper and lower slotted bolt holes 43 and 44 together with the shoulder portion 46 and the lateral flange 47 makes possible the adjustment of the attachment pieces 37 at two different elevations to accommodate three different elevations of the bight portion of the flexible cable 33.

FIGS. 7 and 8 show at 37′ a modified form of attachment piece. It will be noted that ribs 50 are struck from the shoulder portion 46 and the lateral flange 47 and connecting section 51 in order to rigidify the construction. The lower end 52 is formed, as shown, to rigidify this section.

FIGS. 9–12 show, generally, at 54 an attachment piece for the upper ends of the safety support 32′ that can be employed for supporting one end of the bottom connecting rod 31′ should it become disengaged from the brake rigging. Each attachment piece 54 has upper and lower bolt holes 55 and 56 for receiving bolts 57 to locate it at different elevations on the brake beam 30′.

For angularly positioning the attachment pieces 54 on the brake beam 30′, upper and lower slots 58—58 and 59—59, respectively, are formed in their upper ends. For example, the attachment pieces 54 can be located at an angle of 13° either side of their vertical positions. This is illustrated in FIG. 9 for the left attachment piece 54. The slots 58 and 59 are arranged to individually receive a flange 60 extending laterally from a generally triangularly-shaped positioning bracket that is shown, generally, at 61 in FIGS. 13–15. At its lower end, each positioning bracket 61 has a slotted opening 62 for receiving the bolt 57. At its upper end, each bracket 61 has a rearwardly extending flange 63 for overlying the upper side of the brake beam 30′ as shown in FIG. 10.

It will be understood that the lengths of the flexible cables 33′ are so chosen that normally the bight portions are spaced somewhat from the undersides of the bottom connecting rod 31′. The upper sleeve stops 34′ are swagged securely to the upper ends of the cables 33′. Then they are inserted through the upper circular portions 35′ of the keyhole-shaped openings 36′ in the lower ends of the attachment pieces 54 which have been properly mounted on the brake beam 30′. The portions of the flexible cables 33′ immediately below the sleeve stops are then swung through the slots 39′ in the foot portions 38′ followed by swagging of the lower sleeve stops 40′ securely to the flexible cables 33′ and against the undersides of the foot portions 38′.

It will be seen that each attachment piece 54 has a raised and lowered position and that each has three angular orientations. Thereby a wide range of adjustments may be provided for the bight portion of each cable 33′.

Referring to FIG. 16, an attachment piece is indicated at 70 for each upper end of the safety support 32″ that can be employed for supporting one end of the bottom connecting rod 31″ should it become disengaged from the brake rigging. Each attachment piece 70 is adapted to be mounted on the associated brake beam 30″ by an intermediate or underlying positioning bracket indicated generally at 71.

Referring to FIGS. 21–23, it will be seen that each positioning bracket 71 is comprised of a flat generally elongated member 72 provided with a vertical bolt-receiving slot 73 adjacent its lower end and a screw or bolt-receiving aperture 74 adjacent its upper end. The upper end is also provided with a pair of out-turned ears 75—75 which may be integrally formed with the positioning bracket 71 and the horizontal undersides of which are adapted to engage the adjacent top surface of brake beam 30″ as shown in FIG. 17.

Each positioning bracket 71 is adapted to be mounted on a brake beam 30″ by means of a bolt 76 having its bolt head 77 engaging the inner vertical side of the brake beam 30″ with the shank portion projecting outwardly therefrom. The bolt 76, as well as the positioning bracket 71, are secured in place on the brake beam 30″ by means of tightening up an inner hex nut 78 against the outer face of the member 72. It will be understood that the elongated slot 73 allows the positioning bracket 71 to be adjusted vertically so that the undersides of the ears 75 bear against the upper horizontal surface of the brake beam 30″. After each positioning bracket 71 has been mounted in the manner described on a brake beam 30″, it is relatively easy to mount the attachment pieces 70 which will now be described with particular reference to FIGS. 18–20.

Preferably each attachment piece 70 is made in the form of a stamping from steel or other suitable metal so as to have an upper tapered section 80, an intermediate horizontal offset section 81, a lower elongated section 82 and a bottom horizontal foot portion 83. The upper section 80 is provided with an elongated vertical slot 84. The lower section 82 is provided with a multiplicity of bolt-receiving apertures 85—85 in a predetermined pattern. At its lower end, the lower section 82 also is provided with key-shaped opening 36″ having upper circular portion 35″ with the slot portion thereof extending into the foot portion 83 as indicated at 39″, (FIG. 19). The slot 84 and apertures 85 allow each attachment piece 70 to be mounted both at four different elevations and at two different angles on one of the positioning brackets 71 as will now be apparent from FIG. 16.

First, the desired aperture 85 of an attachment piece 70 is placed over the protruding end of the bolt 76 so as to give the piece the desired elevation and vertical or angled orientation. Thereafter, the screw-headed bolt 86 is inserted through the slot 84 in alignment with the threaded aperture 74 in the mounting bracket 71. Then a clamping nut 87 is applied to the outer end of the bolt 76 and this nut is tightened down against the outer face of the attachment piece 70 while the screw-head of the bolt 86 is tightened down against the outer face on opposite sides of the slot 84. It will be seen from FIG. 16 wherein the right-hand attachment piece 70 is mounted in a position extending at right angles to the length of the brake beam 30″ while the left-hand attachment piece 70 is mounted at an angle with respect to the beam.

The embodiment shown and described in connection with FIGS. 16–22 not only has the advantage of offering a multiplicity of adjustments, both vertically and angularly but, in addition, the positioning brackets 71 may be first independently secured in place and ready to receive an attachment piece 70 at the desired elevation and angle.

Figure 24:
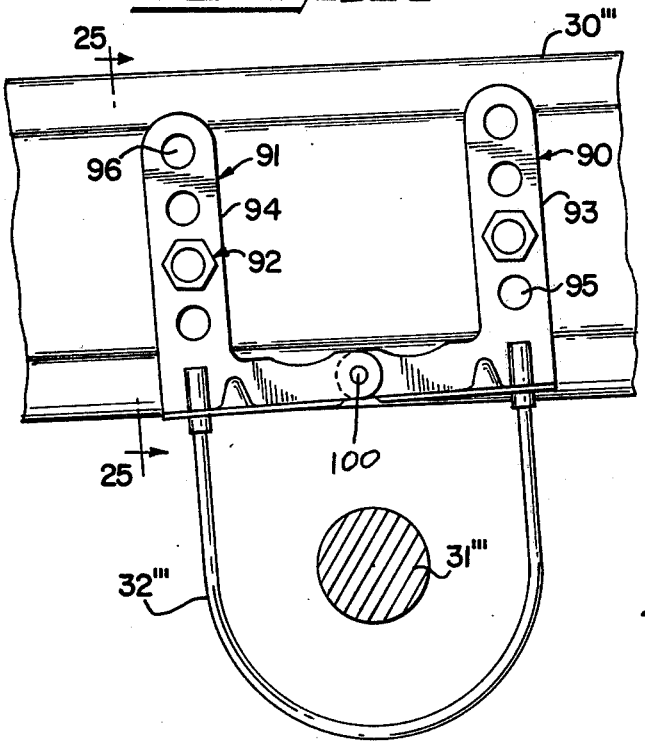
FIG. 24 is a fragmentary, front elevational view similar to FIGS. 2, 9 and 16 showing a further embodiment of the invention.

Referring to FIG. 24, right-hand and left-hand attachment pieces 90 and 91, respectively, are shown mounted on a brake beam 30‴ for supporting the upper opposite ends of a safety support 32‴ for supporting one end of a bottom connecting rod 31‴ should it become disengaged from the brake rigging. Each attachment piece 90 and 91 is adapted to be mounted at various elevations on the associated brake beam 30‴ by means of a single nut and bolt combination indicated at 92. Each of the attachment pieces 90 and 91 is L-shaped with the vertical legs 93 and 94, respectively, being provided with a plurality of mounting holes 95 and 96, respectively.

The lower horizontal legs of the attachment pieces 90 and 91 are essentially the same except that one is left-handed and one is right-handed. These horizontal legs are of such length that the distal ends thereof overlap so that they may be pivotally connected by means of a pin 100 carried by one (i.e. horizontal leg 97) while the distal end of the other (i.e. leg 98) is provided with an aperture 101 for receiving the pin 100. Perferably the pin 100 has a laterally extending tab 102 at the rear integrally formed therewith whereby it may be suitably secured as by spot welding, to the back-side of its horizontal leg 97.

Each of the horizontal legs 97 and 98 has a laterally extending foot or flange 103 and 104, respectively. The junctures between the foot portions 103 and 104 and the adjacent vertical portions of the attachment pieces 90 and 91, respectively, are provided with the keyhole openings for receiving the upper ends of the safety cable 32‴ as described above in connection with FIGS. 2–6. These keyhole openings are comprised of sections 35‴, 36‴, and 39‴. Integrally formed gussets or indentations 105 are provided in the horizontal legs 97 and 98 for rigidifying the attachment pieces 90 and 91.

From FIG. 24, it will be observed that the attachment pieces 90 and 91 as mounted provide a rigid and stable 3-point or triangular support for the safety strap or cable 32‴. Thus, the bolts 92 establish two fixed points while the pin 100 establishes the third fixed point of a triangle. While the bolts 92 remain fixed, the particular location of pin 100 will depend upon which of the holes 95 and 96 are placed over the bolts. When other than corresponding holes 95 and 96 are placed over the bolts 92, the attachment pieces will be cocked at various angles.

Figure 29:
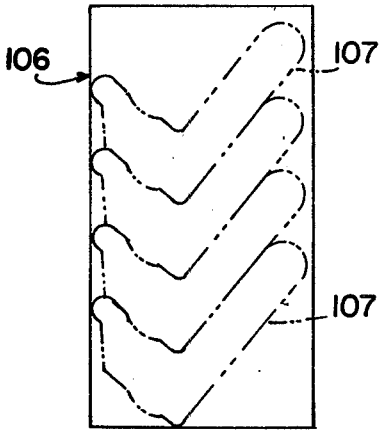
FIG. 29 is a plan view of a piece of sheet material showing in broken line the shape of stampings that may be used to form the attachment pieces shown in FIGS. 24 and 26.
Figure 27:
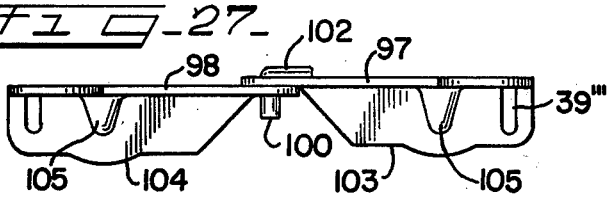
FIG. 27 is a top plan view taken on line 27—27 of FIG. 26.
Figure 28:
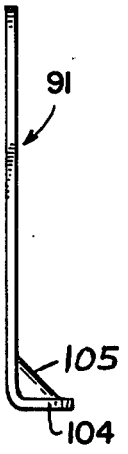
FIG. 28 is a side elevation taken on line 28—28 of FIG. 26.
Figure 26:
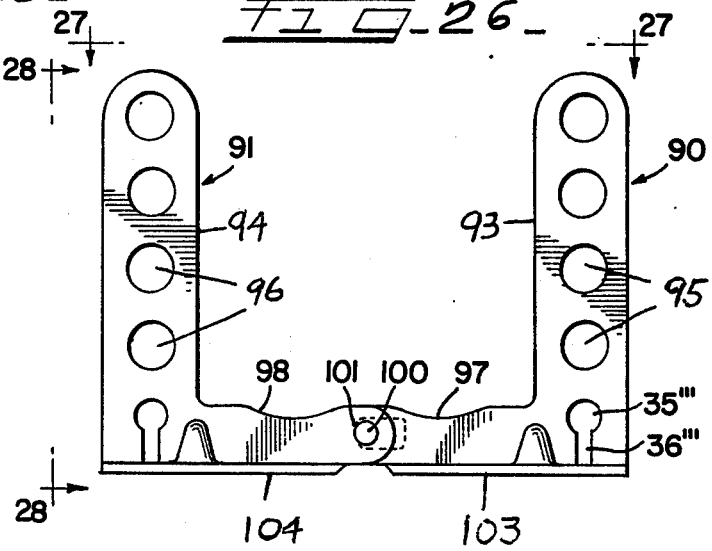
FIG. 26 is a front elevational view of the two attachment pieces shown in FIG. 24.

It will be seen from FIG. 29 that the L-shaped attachment pieces 90 and 91 may be economically stamped from a rectangular sheet of a suitable material such as a steel plate of suitable thickness indicated generally at 106. Each of the stampings 107—107 can be identical. Right-hand and left-hand attachment pieces 90 and 91 are formed from the identical stampings 107 by bending the lower portions thereof in opposite directions to provide the feet 103 and 104.

Figure 25:
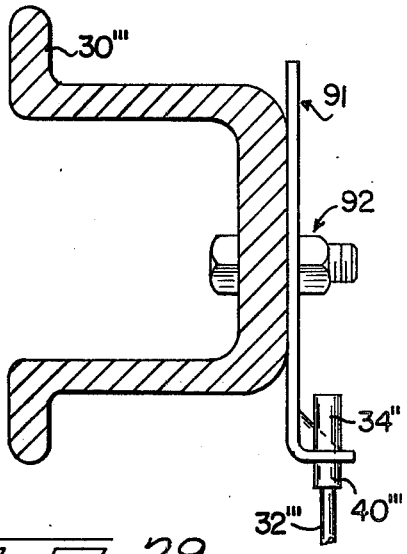
FIG. 25 is a detail sectional view taken on line 25—25 of FIG. 24.
Figure 30:
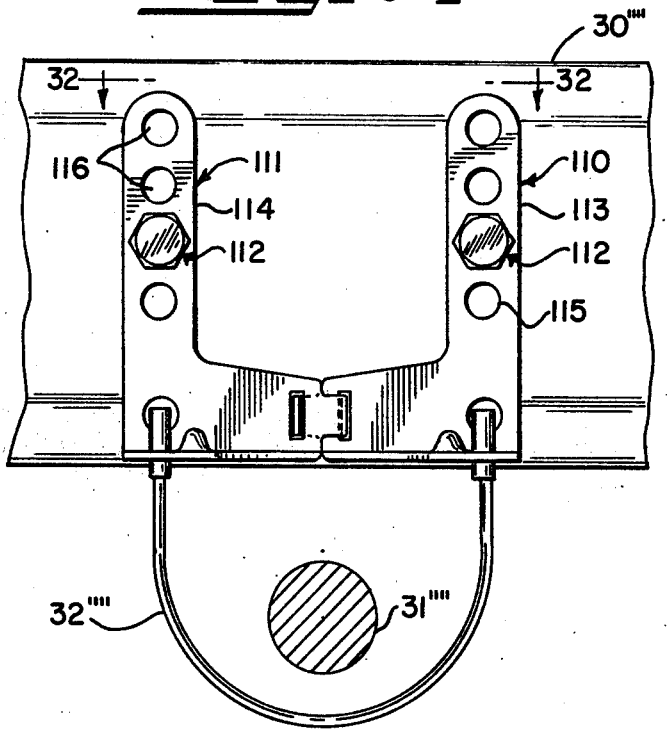
FIG. 30 is a fragmentary, front elevational view similar to FIGS. 2, 9, 16 and 24 showing a further embodiment of the invention.
Figure 33:
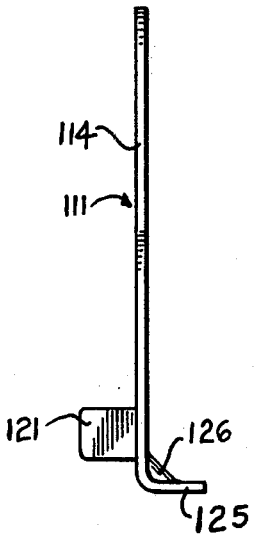
FIG. 33 is a side elevation taken on line 33—33 of FIG. 31.
Figure 31:
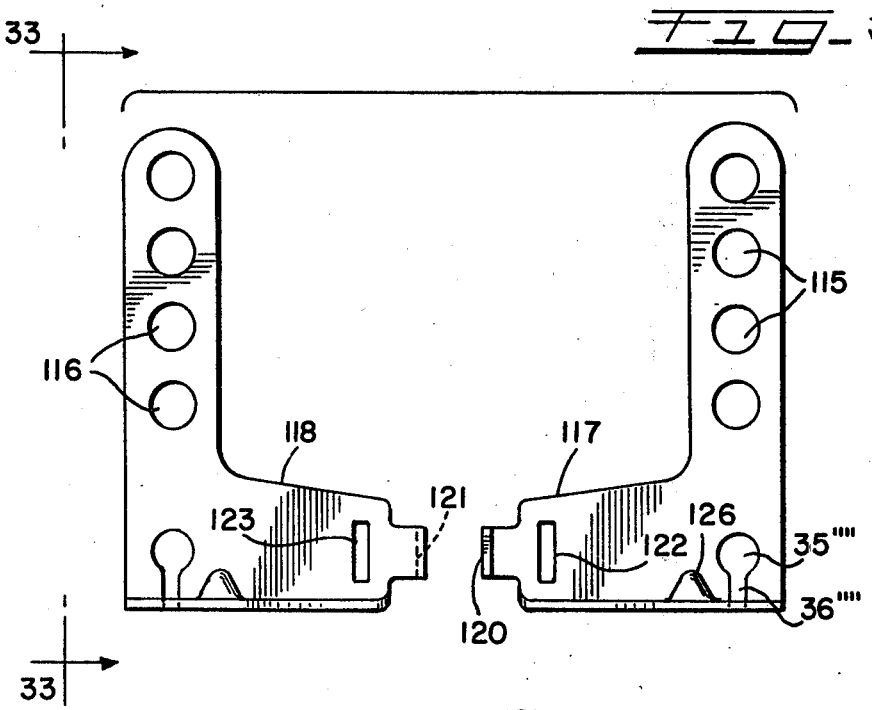
FIG. 31 is a front elevational view of the two attachment pieces shown in FIG. 30 separated from each other.
Figure 32:
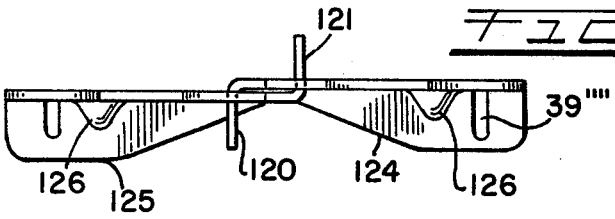
FIG. 32 is a top plan view taken on line 32—32 of FIG. 30.

Referring to FIG. 30, right-hand and left-hand attachment pieces 110 and 111, respectively, are shown mounted on a brake beam 30⁗ for supporting the upper opposite ends of a safety support 32⁗ for in turn supporting one end of a bottom connecting rod 31⁗ should it become disengaged from the brake rigging. Each attachment piece 110 and 111 is adapted to be mounted at various elevations on the associated brake beam 30⁗ by means of a single nut and bolt combination indicated generally at 112 and corresponding to the nut and bolt combinations 92 in FIGS. 24 and 25. Each of the attachment pieces 110 and 111 is L-shaped with the vertical legs 113 and 114, respectively, being provided with a plurality of mounting holes 115 and 116, respectively.

The lower horizontal legs 117 and 118 of the attachment pieces 110 and 111, respectively, are essentially the same except that one is left-handed and one is right-handed. Each lower leg 117 and 118 has at its distal end a right angle tab 120 and 121, respectively, and tab-receiving slots 122 and 123, respectively. The horizontal legs 117 and 118 are of such length that the distal ends thereof overlap so that they may be interconnected by means of the tabs 120 and 121 and slots 122 and 123 as shown in FIG. 30. It will be observed from FIG. 30 that the tabs 120 and 121 have a loose or sloppy fit in the slots 123 and 122, respectively, thereby allowing some flexibility or freedom of angular adjustment between the pieces 110 and 111 so as to facilitate mounting.

Each of the horizontal legs 117 and 118 has a laterally extending foot or flange 124 and 125, respectively. The junctures between the foot portions 124 and 125 and the adjacent vertical portions of the attachment pieces 110 and 111, respectively, are provided with the keyhole openings for receiving the upper ends of the safety cable 32'''' as described above in connection with FIGS. 2–6. These keyhole openings are comprised of sections 35'''', 36'', "and 39''''. Integrally formed gussets or indentations 126 are provided in the horizontal legs 117 and 118 for rigidifying the attachment pieces 110 and 115.

From FIG. 30, it will be observed that the attachment pieces 110 and 111 as mounted provide a stable 3-point or triangular support for the safety strap or cable 32''''. Thus, the bolts 112 establish two fixed points while the interfitting tabs 120 and 121 and slots 123 and 122 establish the third point of the triangle.

It will be appreciated that the L-shaped attachment pieces 110 and 111 may be economically stamped and formed from a sheet of a suitable material such as a steel plate of suitable thickness. Right-hand and left-hand attachment pieces 110 and 111 are formed from the identical stampings by bending the tabs 120 and 121 and feet 124 and 125 in opposite directions.

I claim:

1. For combination with a railway car having spaced apart brake beams and a bottom connecting rod disposed on the underside thereof forming part of a brake rigging likely to become detached and drop to the road bed, means for preventing said bottom connecting rod from so dropping comprising: a flexible cable for underlying said bottom connecting rod with the ends extending upwardly, adjustable attachment pieces adapted to receive the upper ends of said flexible cable for securement at varying elevations to one of said brake beams and having offset portions at different elevations for overlying upwardly facing surfaces of said brake beam at correspondingly different elevations, and means for fastening said attachment pieces in different positions on said brake beam thereby adjusting the height of the lowermost portion of said cable.

2. For combination with a railway car having spaced apart brake beams and a bottom connecting rod on the underside thereof forming part of a brake rigging and likely to become detached and drop to the road bed, means for preventing said bottom connecting rod from dropping as called for in claim 1 wherein said attachment pieces are each provided with upper and lower bolt holes for receiving mounting bolts to locate said pieces at different elevations on said brake beams.

3. For combination with a railway car having spaced apart brake beams and a bottom connecting rod on the underside thereof forming part of a brake rigging likely to become detached and drop to the road bed, means for preventing said bottom connecting rod from dropping as called for in claim 1 wherein said attachment pieces have deformed rib portions integral with said offset portions to rigidify the same.

4. For combination with a railway car having spaced apart brake beams and a bottom connecting rod on the underside thereof forming part of a brake rigging likely to become detached and drop to the road bed, means for preventing said bottom connecting rod from dropping comprising: a flexible cable for underlying said bottom connecting rod with the ends extending upwardly, adjustable attachment pieces adapted to receive the upper ends of said flexible cable for securement at varying elevations to one of said brake beams and having laterally extending slotted foot portions for receiving the respective ends of said flexible cable, stop means secured to said cable ends preventing downward withdrawal of the same from said foot portions, and stop means secured to said cable ends and juxtaposed to the undersides of said foot portions preventing upward movement of said cable ends.

5. For combination with a railway car having spaced apart brake beams and a bottom connecting rod on the underside thereof forming part of a brake rigging likely to become detached and drop to the road bed, means for preventing said bottom connecting rod from dropping as called for in claim 4 wherein said slots in said foot portions extend into the lower ends of keyhole-shaped slots formed in the lower ends of said attachment pieces which terminate in upper circular portions for receiving said stop means at said ends of said flexible cable.

6. For combination with a railway car having spaced apart brake beams and a bottom connecting rod on the underside thereof forming part of a brake rigging likely to become detached and drop to the road bed, means for preventing said bottom connecting rod from dropping comprising: a flexible cable for underlying said bottom connecting rod with the ends extending upwardly, adjustable attachment pieces adapted to receive the upper ends of said flexible cable for securement at varying elevations to one of said brake beams and provided with generally radially extending slots for receiving a vertical stationary positioning flange to locate said attachment pieces in different angular positions with respect to said brake beam.

7. For combination with a railway car having spaced apart brake beams and a bottom connecting rod on the underside thereof forming part of a brake rigging likely to become detached and drop to the road bed, means for preventing said bottom connecting rod from dropping as called for in claim 6 wherein said flange extends laterally from a positioning bracket juxtaposed behind each attachment piece.

8. For combination with a railway car having spaced apart brake beams and a bottom connecting rod on the underside thereof forming part of a brake rigging likely to become detached and drop to the road bed, means for preventing said bottom connecting rod from dropping as called for in claim 7 wherein said positioning bracket is generally triangularly-shaped with said flange extending from its upper end and has an oppositely extending horizontal flange at its upper end for overlying the upper surface of said brake beam.

9. For combination with a railway car having spaced apart brake beams and a bottom connecting rod on the underside thereof forming part of a brake rigging likely to become detached and drop to the road bed, means for preventing said bottom connecting rod from dropping comprising: a flexible cable for underlying said bottom connecting rod with the ends extending upwardly, adjustable attachment pieces adapted to receive the upper ends of said flexible cable for securement at varying elevations to said brake beams, and means for fastening said attachment pieces in different positions on said brake beams thereby adjusting the height of the lowermost portions of said cables wherein a positioning bracket is mounted on each brake beam by a bolt having a laterally and outwardly projecting shank and each positioning bracket carries at a location above said bolt a screw, and wherein each said attachment piece has an upper portion provided with a generally vertically extending slot for receiving the shank of said screw and a lower portion provided with a plurality of vertically and laterally spaced apertures for receiving said bolt, each said attachment piece being securable at different locations and in different angular positions by tightening said screw and tightening a clamp nut on said bolt against the outer face of said attachment piece.

10. For combination with a railway car having spaced apart brake beams and a bottom connecting rod on the underside thereof forming part of a brake rigging likely to become detached and drop to the road bed, means for preventing said bottom connecting rod from dropping as called for in claim 9 wherein each said positioning bracket has ears with bottom edges adapted to bear on an upwardly facing surface of said brake beam.

11. For combination with a railway car having spaced apart brake beams and a bottom connecting rod on the underside thereof forming part of a brake rigging likely to become detached and drop to the road bed, means for preventing said bottom connecting rod from dropping as called for in claim 9 wherein said lower portion of each said attachment piece is outwardly offset from said upper portion by a laterally extending offset portion integrally connecting the lower end of said upper portion with the upper end of said lower portion.

12. For combination with a railway car having spaced apart brake beams and a bottom connecting rod on the underside thereof forming part of a brake rigging and likely to become detached and drop to the road bed, means for preventing said bottom connecting rod from dropping comprising: a flexible cable for underlying said bottom connecting rod with the ends extending upwardly, adjustable attachment pieces adapted to receive the upper ends of said flexible cable for securement at varying elevations to one of said brake beams, said attachment pieces being in the form of right-hand and left-hand L-shaped members with the vertical legs of said members having a plurality of vertically spaced bolt holes therein whereby each of said members may be bolted to a brake beam at different elevations thereon and with the distal ends of the horizontal legs of said members overlapping, and means interconnecting said overlapping ends.

13. Means for preventing said bottom connecting rod from dropping as called for in claim 12 wherein said means interconnecting said overlapping ends comprises a fixed pin projecting laterally from the distal end of the horizontal leg of one of said L-shaped members and the overlapping distal end of the horizontal leg of the other l-shaped member has an aperture therein for receiving said pin therein.

14. Means for preventing said bottom connecting rod from dropping as called for in claim 12 wherein said means interconnecting said overlapping ends comprises a tab projecting from the distal end of the horizontal leg of each said L-shaped member and a tab-receiving slot in each said overlapping distal end with said tab on each of said distal ends projecting through said slot in the other of said distal ends.

* * * * *